US010424240B2

(12) United States Patent
Lee et al.

(10) Patent No.: US 10,424,240 B2
(45) Date of Patent: Sep. 24, 2019

(54) LED DISPLAY MODULE AND DISPLAY APPARATUS

(71) Applicant: SAMSUNG ELECTRONICS CO., LTD., Suwon-si (KR)

(72) Inventors: Ho-seop Lee, Seongnam-si (KR); Dong-myung Son, Yongin-si (KR); Jae-hyang Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/808,282

(22) Filed: Nov. 9, 2017

(65) Prior Publication Data

US 2018/0130405 A1 May 10, 2018

(30) Foreign Application Priority Data

Nov. 9, 2016 (KR) ..... 10-2016-0148788

(51) Int. Cl.

| | |
|---|---|
| ***G09G 3/32*** | (2016.01) |
| ***G09G 3/20*** | (2006.01) |
| ***G09G 3/3216*** | (2016.01) |

(52) U.S. Cl.

CPC ..... *G09G 3/32* (2013.01); *G09G 3/2003* (2013.01); *G09G 3/2022* (2013.01); (Continued)

(58) Field of Classification Search

CPC ..... G09G 3/32; G09G 3/3208 (Continued)

(56) References Cited

U.S. PATENT DOCUMENTS

| | | | |
|---|---|---|---|
| 7,167,154 | B2 | 1/2007 | Sato et al. |
| 8,427,402 | B2 | 4/2013 | Smith |

(Continued)

FOREIGN PATENT DOCUMENTS

| | | | |
|---|---|---|---|
| EP | 1 391 864 | A2 | 2/2004 |
| EP | 1 876 582 | A2 | 1/2008 |

(Continued)

OTHER PUBLICATIONS

Communication dated Oct. 24, 2017 by the International Searching Authority in Int'l Appl. No. PCT/KR2017/007038 (PCT/ISA/210).

(Continued)

*Primary Examiner* — Koosha Sharifi-Tafreshi

(74) *Attorney, Agent, or Firm* — Sughrue Mion, PLLC

(57) ABSTRACT

An LED display module and a display apparatus are provided. The LED display module includes: an LED part including a plurality of first LEDs in a first row and a plurality of second LEDs in a second row; a first driver integrated circuit (IC) commonly connected to at least one of the plurality of first LEDs and at least one of the plurality of second LEDs, and a second driver IC commonly connected to another at least one of the plurality of first LEDs and another at least one of the plurality of second LEDs; a first switch connected to a plurality of the first LEDs disposed in odd-numbered columns of the first row, a second switch connected to a plurality of the second LEDs disposed in odd-numbered columns of the second row, a third switch connected to a plurality of the first LEDs disposed in even-numbered columns of the first row, and a fourth switch connected to a plurality of the second LEDs disposed in even-numbered columns of the second row; and a controller configured to control the first to fourth switches to be sequentially turned on.

9 Claims, 10 Drawing Sheets

(52) U.S. Cl.
CPC ... *G09G 3/3216* (2013.01); *G09G 2300/0804* (2013.01); *G09G 2310/021* (2013.01); *G09G 2310/0224* (2013.01); *G09G 2310/0235* (2013.01); *G09G 2310/0297* (2013.01); *G09G 2330/02* (2013.01)

(58) Field of Classification Search
USPC ..... 345/76, 82, 83
See application file for complete search history.

(56) References Cited

U.S. PATENT DOCUMENTS

| | | | | |
|---|---|---|---|---|
| 2007/0236420 | A1* | 10/2007 | Huang | G09G 3/3216 345/76 |
| 2008/0007495 | A1* | 1/2008 | Kawashima | G09G 3/3216 345/80 |
| 2008/0150874 | A1 | 6/2008 | Kida et al. | |
| 2010/0188438 | A1 | 7/2010 | Kang | |
| 2012/0038615 | A1* | 2/2012 | Leung | H05B 33/0824 345/212 |
| 2012/0105494 | A1 | 5/2012 | Lee et al. | |
| 2012/0327129 | A1 | 12/2012 | Li et al. | |
| 2013/0120226 | A1 | 5/2013 | Djordjev et al. | |
| 2014/0319486 | A1 | 10/2014 | Hong | |

FOREIGN PATENT DOCUMENTS

| | | | |
|---|---|---|---|
| JP | 3564359 | B2 | 9/2004 |
| JP | 3950912 | B2 | 8/2007 |
| KR | 10-2008-0055139 | A | 6/2008 |
| KR | 10-2009-0009436 | A | 1/2009 |
| KR | 10-1169050 | B1 | 7/2012 |
| KR | 10-2014-0127070 | A | 11/2014 |
| KR | 10-1611904 | B1 | 4/2016 |

OTHER PUBLICATIONS

Communication dated Oct. 24, 2017 by the International Searching Authority in Int'l Appl. No. PCT/KR2017/007038 (PCT/ISA/237).
Communication dated Apr. 5, 2019 issued by the European Intellectual Property Office in counterpart European Application No. 17869587.0.

* cited by examiner

LED DISPLAY MODULE AND DISPLAY APPARATUS

CROSS-REFERENCE TO RELATED APPLICATION

This application claims priority under 35 U.S.C. § 119 from Korean Patent Application No. 10-2016-0148788, filed in the Korean Intellectual Property Office on Nov. 9, 2016, the disclosure of which is incorporated by reference herein in its entirety.

BACKGROUND

1. Field

Apparatuses and methods consistent with one or more exemplary embodiments relate generally to an LED display module and a display apparatus, and for example to an LED display module for receiving and displaying an image signal through a signal interface, and a display apparatus.

2. Description of Related Art

A display apparatus including various types of display panels has been developed according to developments in technology. In the past, display apparatuses including CRT and LCD were used. Recently, a display apparatus including a light emitting diode (LED) display module including an organic LED (OLED) is being developed.

An LED display apparatus may be implemented by combining a plurality of LED display modules. The LED display module includes a plurality of LEDs. The brightness of the LED is determined by the amount of current flowing through the LED. Therefore, LEDs use a constant current driver integrated circuit (IC) to maintain constant brightness. Typically, each LED is connected to a respective driver IC.

As illustrated in FIG. 1, a related art LED display module includes a plurality of LEDs arranged in a line for each line. The related art LED display module includes a switch connected to a power source for each line. In addition, the related art LED display module includes the driver ICs connected to the respective LEDs and controls the LEDs line-by-line according to an on/off state of the switch.

That is, an LED display module including, by way of example, 1000 LEDs may include 1000 driver ICs. In the related art LED display module, a number of driver ICs corresponding to the number of LEDs is used. Therefore, when the LED display module is implemented with a large screen, the structure is complicated and power consumption is increased. In addition, the LED display module has a problem in that the volume increases and the yield decreases.

SUMMARY

Aspects of one or more exemplary embodiments provide an LED display module and a display apparatus that can reduce the number of driver ICs without degrading image quality.

According to an aspect of an exemplary embodiment, there is provided a light emitting diode (LED) display module, including: an LED part including a plurality of first LEDs in a first row and a plurality of second LEDs in a second row; a first driver integrated circuit (IC) commonly connected to at least one of the plurality of first LEDs and at least one of the plurality of second LEDs, and a second driver IC commonly connected to another at least one of the plurality of first LEDs and another at least one of the plurality of second LEDs; a first switch connected to a plurality of the first LEDs disposed in odd-numbered columns of the first row, a second switch connected to a plurality of the second LEDs disposed in odd-numbered columns of the second row, a third switch connected to a plurality of the first LEDs disposed in even-numbered columns of the first row, and a fourth switch connected to a plurality of the second LEDs disposed in even-numbered columns of the second row; and a controller configured to control the first to fourth switches to be sequentially turned on.

The LED part may further include: a plurality of third LEDs in a third row, and a plurality of fourth LEDs in a fourth row; a third driver IC commonly connected to at least one of the plurality of third LEDs and at least one of the plurality of fourth LEDs, and a fourth driver IC commonly connected to another at least one of the plurality of third LEDs and another at least one of the plurality of fourth LEDs; and a fifth switch connected to a plurality of the third LEDs disposed in odd-numbered columns of the third row, a sixth switch connected to a plurality of the fourth LEDs disposed in odd-numbered columns of the fourth row, a seventh switch connected to a plurality of the third LEDs disposed in even-numbered columns of the third row, and an eighth switch connected to a plurality of the fourth LEDs disposed in even-numbered columns of the fourth row, and wherein the controller may be configured to control the first, second, third, and fourth switches to be sequentially turned on, and to control the fifth, sixth, seventh, and eighth switches to be turned on simultaneously with the first, second, third, and fourth switches, respectively.

The first driver IC may be commonly connected to two first LEDs disposed in first and second columns of the first row and two second LEDs disposed on the first and second columns of the second row; and the second driver IC may be commonly connected to two first LEDs disposed in third and fourth columns of the first row and two second LEDs disposed in the third and fourth columns of the second row.

The first driver IC may be commonly connected to one first LED disposed in a first column of the first row and one second LED disposed in a second column of the second row; and the second driver IC may be commonly connected to one first LED disposed in the second column of the first row and one second LED disposed in the first column of the second row.

The first driver IC may be commonly connected to an anode of each of the first LED disposed in the first column of the first row and the second LED disposed in the second column of the second row; and the second driver IC may be commonly connected to an anode of each of the first LED disposed in the second column of the first row and the second LED disposed in the first column of the second row.

The first driver IC may be commonly connected to a cathode of each of the first LED disposed in the first column of the first row and the second LED disposed in the second column of the second row; and the second driver IC may be commonly connected to a cathode of each of the first LED disposed in the second column of the first row and the second LED disposed in the first column of the second row.

The controller may be configured to, in response to a specific switch being turned on, selectively disable a driver IC controlling a current of an LED connected to the specific switch based on an image to be displayed in the LED part.

According to an aspect of another exemplary embodiment, there is provided an LED display module, including: an LED part including a plurality of first LEDs in a first row and a plurality of second LEDs in a second row; a plurality of first driver ICs, each connected to a red LED among the plurality of first LEDs and not connected to green LEDs and blue LEDs among the plurality of first LEDs; a plurality of second driver ICs, each commonly connected to a green LED and a blue LED among the plurality of first LEDs and not connected to red LEDs among the plurality of first LEDs; a plurality of third driver ICs, each connected to a red LED among the plurality of second LEDs and not connected to green LEDs and blue LEDs among the plurality of second LEDs; a plurality of fourth driver ICs, each commonly connected to a green LED and a blue LED among the plurality of second LEDs and not connected to red LEDs among the plurality of second LEDs; a first switch commonly connected to the red LEDs among the plurality of first LEDs, a second switch commonly connected the green LEDs and the blue LEDs among the plurality of first LEDs, a third switch commonly connected to the red LEDs among the plurality of second LEDs, and a fourth switch commonly connected to the green LEDs and the blue LEDs among the plurality of second LEDs; and a controller configured to control the first to fourth switches to sequentially turn on.

The first switch and the third switch may be connected to a first power source to supply a first voltage to the red LEDs among the plurality of first LEDs and the red LEDs among the plurality of second LEDs; and the second switch and the fourth switch may be connected to a second power source to supply a second voltage, different from the first voltage, to the green LEDs and the blue LEDs among the plurality of first LEDs and the green LEDs and the blue LEDs among the plurality of second LEDs.

The plurality of first driver ICs and the plurality of second driver ICs may be connected to anodes of the plurality of first LEDs, and the plurality of third driver ICs and the plurality of fourth driver ICs may connected to anodes of the plurality of second LEDs.

The plurality of first driver ICs and the plurality of second driver ICs may be connected to cathodes of the plurality of first LEDs, and the plurality of third driver ICs and the plurality of fourth driver ICs may be connected to cathodes of the plurality of second LEDs.

According to an aspect of another exemplary embodiment, there is provided a display apparatus, including: an LED display module; and a processor configured to control driving of the LED display module, wherein the LED display module includes: an LED part including a plurality of first LEDs in a first row and a plurality of second LEDs in a second row; a first driver IC commonly connected to at least one of the plurality of first LEDs and at least one of the plurality of second LEDs, and a second driver IC commonly connected to another at least one of the plurality of first LEDs and another at least one of the plurality of second LEDs; a first switch connected to a plurality of the first LEDs disposed in odd-numbered columns of the first row, a second switch connected to a plurality of the second LEDs disposed in odd-numbered columns of the second row, a third switch connected to a plurality of the first LEDs disposed in even-numbered columns of the first row, and a fourth switch connected to a plurality of the second LEDs disposed in even-numbered columns of the second row; and a controller configured to control the first to fourth switches to be sequentially turned on, and wherein the processor is configured to control the controller.

According to an aspect of another exemplary embodiment, there is provided a light emitting diode (LED) display module, including: an LED part including a plurality of first LEDs and a plurality of second LEDs; a first driver integrated circuit (IC) commonly connected to at least one of the plurality of first LEDs and at least one of the plurality of second LEDs, and a second driver IC commonly connected to another at least one of the plurality of first LEDs and another at least one of the plurality of second LEDs; a first switch connected to a first plurality of the first LEDs, a second switch connected to a first plurality of the second LEDs, a third switch connected to a second plurality of the first LEDs, and a fourth switch connected to a second plurality of the second LEDs; and a controller configured to control the first to fourth switches to be sequentially turned on.

The LED part may further include: a plurality of third LEDs and a plurality of fourth LEDs; a third driver IC commonly connected to at least one of the plurality of third LEDs and at least one of the plurality of fourth LEDs, and a fourth driver IC commonly connected to another at least one of the plurality of third LEDs and another at least one of the plurality of fourth LEDs; and a fifth switch connected to a first plurality of the third LEDs, a sixth switch connected to a first plurality of the fourth LEDs, a seventh switch connected to a second plurality of the third LEDs, and an eighth switch connected to a second plurality of the fourth LEDs, and wherein the controller is configured to control the first, second, third, and fourth switches to be sequentially turned on, and to control the fifth, sixth, seventh, and eighth switches to be turned on simultaneously with the first, second, third, and fourth switches, respectively.

According to an aspect of another exemplary embodiment, there is provided an LED display module, including: an LED part including a plurality of first LEDs and a plurality of second LEDs; a plurality of first driver ICs, each connected to at least one LED among the plurality of first LEDs; a plurality of second driver ICs, each commonly connected to at least two LEDs among the plurality of first LEDs; a plurality of third driver ICs, each connected to at least one LED among the plurality of second LEDs; a plurality of fourth driver ICs, each commonly connected to at least two LEDs among the plurality of second LEDs; a first switch commonly connected to the LEDs connected to the plurality of first driver ICs, a second switch commonly connected to the LEDs connected to the plurality of second driver ICs, a third switch commonly connected to the LEDs connected to the plurality of third driver ICs, and a fourth switch commonly connected to the LEDs connected to the plurality of fourth driver ICs; and a controller configured to control the first to fourth switches to sequentially turn on.

According to aspects of various exemplary embodiments described above, the LED display module and the display apparatus can reduce power consumption and volume as the number of driver ICs decreases.

In addition, the LED display module and the display apparatus have a simpler structure than the related art display panel, thereby increasing the yield and reducing the cost.

In addition, the LED display module and the display apparatus can prevent deterioration of image quality by performing time division drive as well as spatial division.

BRIEF DESCRIPTION OF THE DRAWINGS

The above and/or other aspects will become more apparent by reference to specific exemplary embodiments which are illustrated in the appended drawings. Understanding that these drawings depict exemplary embodiments and are not therefore to be considered to be limiting of the scope of the disclosure, the principles herein are described and explained with additional specificity and detail through the use of the accompanying drawings, in which.

DETAILED DESCRIPTION

Figure 1:
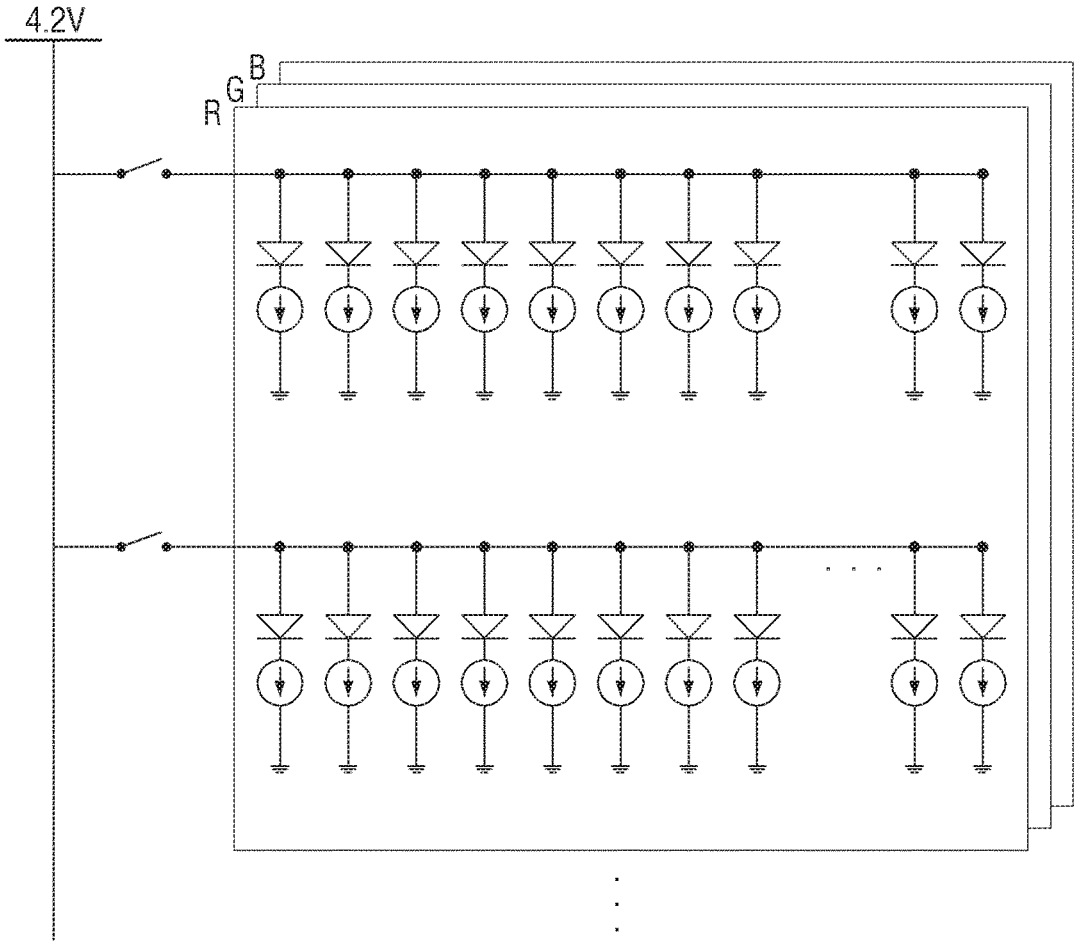
FIG. 1 is a diagram illustrating a related art LED display module.
Figure 2:
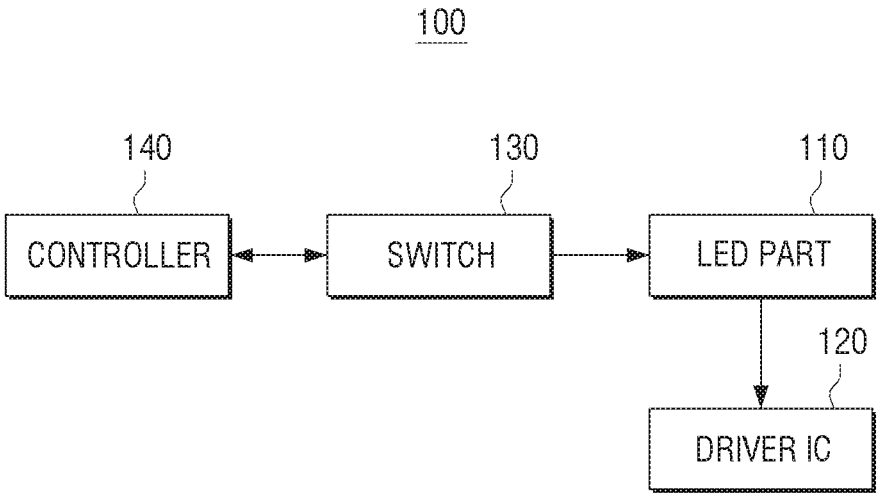
FIG. 2 is a block diagram of an LED display module according to an exemplary embodiment.

FIG. 2 is a block diagram of an LED display module 100 according to an exemplary embodiment.

Referring to FIG. 2, the LED display module 100 includes an LED part 110, a driver IC 120, a switch 130, and a controller 140.

The LED part 110 includes a plurality of LEDs. For example, a plurality of first LEDs may be arranged in a first line (e.g., row) of the LED part 110, a plurality of second LEDs may be arranged in a second line, a plurality of third LEDs may be arranged in a third line, and a plurality of fourth LEDs are arranged in the fourth line. A plurality of n-th LEDs are arranged in the n-th line. The LED part 110 may include various number of lines, a number of columns, or a number of LEDs depending on the type, resolution, and implementation of the LED. For example, each LED may output one of red, green, or blue colors. In addition, one LED may output all of red, green, and blue colors depending on the data signal. Each LED may be included in each pixel of the display screen. For example, an LED display panel capable of displaying 1920×1080 Full-HD (high definition) may include 1920×1080 LEDs, that is, 2,073,600 LEDs.

The driver IC 120 maintains a constant amount of current flowing through each LED and is commonly connected to a plurality of LEDs according to a predetermined method among the plurality of first LEDs and the plurality of second LEDs. Therefore, one driver IC 120 is commonly connected to a plurality of LEDs, and maintains a constant amount of current flow through each LED connected thereto. Alternatively, each of the red LEDs may be connected to one driver IC 120, and the green LEDs may be connected to the other driver IC 120 together with the blue LEDs. However, it is understood that one or more other exemplary embodiments are not limited thereto, and a different arrangement of various LEDs may be connected to one or more driver ICs. The LED display module 100 includes a plurality of driver ICs 120. For example, if two LEDs are commonly connected to one driver IC 120 in an LED display panel 100 capable of displaying Full-HD of 1920×1080, the LED display panel 100 may include 1,036,800 drivers ICs 120. Alternatively, if four LEDs in the LED display panel 100 are connected in common to one driver IC 120, the LED display panel 100 may include 518,400 driver ICs 120. Accordingly, when the driver IC 120 is connected to a plurality of LEDs, the number of driver ICs can be significantly reduced as compared to the related art LED display panel.

The switch 130 turns on or off the connected LED by the control of the controller 140. The switch 130 may be connected to a plurality of LEDs according to a predetermined pattern. In an exemplary embodiment, the first switch may be connected to a plurality of first LEDs disposed in odd-numbered columns of the first line. The second switch may be connected to a plurality of first LEDs disposed in even-numbered columns of the first line. The third switch may be connected to a plurality of second LEDs arranged in the odd-numbered columns of the second line and the fourth switch may be connected to the plurality of the second LEDs arranged in the even-numbered columns of the second line. The fifth switch may be connected to a plurality of third LEDs arranged in the odd-numbered columns of the third line and the sixth switch may be connected to the plurality of the third LEDs arranged in the even-numbered columns of the third line. The seventh switch may be connected to a plurality of fourth LEDs arranged in the even-numbered columns of the fourth line and the eighth switch may be connected to the plurality of the fourth LEDs arranged in the odd-numbered columns of the fourth line. The (2n−1)th switch may be connected to the plurality of nth LEDs arranged in the odd-numbered columns of the nth line and the (2n)th switch may be connected to the plurality of the nth LEDs arranged in the even-numbered columns of the nth line. However, it is understood that one or more other exemplary embodiments are not limited thereto, and a different arrangement of various LEDs may be connected to the switches.

For example, according to another exemplary embodiment, the first switch may be connected to a plurality of red LEDs of the first line, and the second switch may be connected to a plurality of green LEDs and one or more blue LEDs of the first line. The third switch may be connected to a plurality of red LEDs of the second line, and the fourth switch may be connected to a plurality of green LEDs and one or more blue LEDs of the second line. The fifth switch may be connected to a plurality of red LEDs of the third line, and the sixth switch may be connected to a plurality of green LEDs and one or more blue LEDs of the third line. The seventh switch may be connected to a plurality of red LEDs of the fourth line, and the eighth switch may be connected to a plurality of green LEDs and one or more blue LEDs of the fourth line. The (2n−1)th switch may be connected to a plurality of red LEDs of the nth line, and the (2n)th switch may be connected to a plurality of green LEDs and one or more blue LEDs of the nth line.

The controller 140 sequentially turns the switch 130 on and off. That is, the controller 140 may turn on or off one or more switches among the first to the (2n)th switches. The controller 140 may control the switch 130 to turn on and off sequentially so that the plurality of LEDs can be time-divided to display an image.

On the other hand, when the switch 130 is turned on, among the LEDs connected to the switch 130 that is turned on, the LED may be located in a pixel that is not displayed according to an image to be displayed on the LED part 100. The controller 140 may control an LED located in a pixel where an image is not displayed so as to display a predetermined color (e.g., black). Alternatively, the controller 140 may control the LED or the driver IC so that pixels for which no image is displayed are not turned on. That is, the controller 140 may selectively disable the driver IC that controls the current of the LED connected to a specific switch based on the image to be displayed in the LED part 110, when the specific switch is turned on.

The LED display module according to various exemplary embodiments will be described below.

Figure 3:
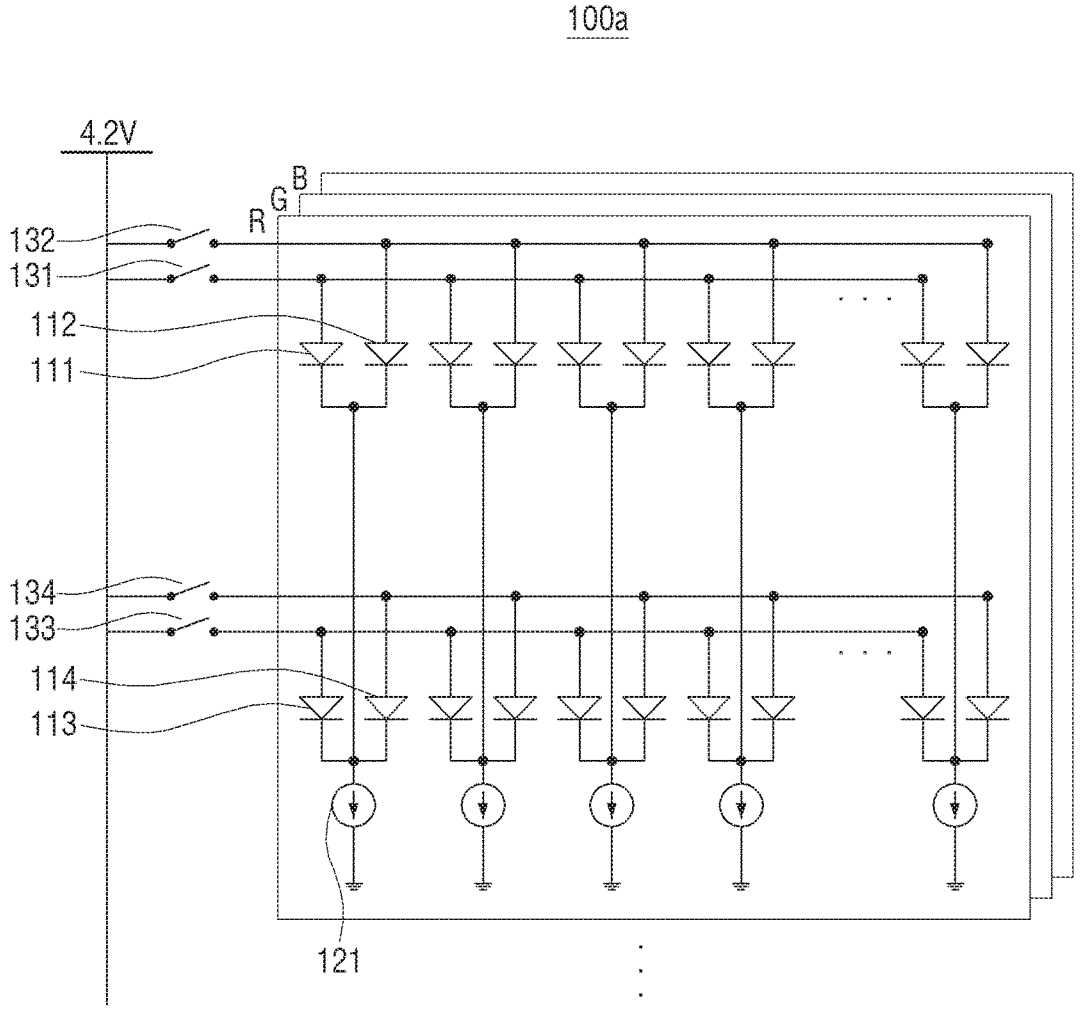
FIG. 3 is a diagram illustrating an LED display module according to a first exemplary embodiment.

FIG. 3 is a diagram illustrating an LED display module 100*a* according to a first exemplary embodiment.

Referring to FIG. 3, the LED display module 100*a* includes LED parts arranged in a line-by-line (e.g., row-by-row) manner, a driver IC, and a switch. In FIG. 3, only the red LED part, the green LED part, and the blue LED part are separately displayed for convenience of explanation. In the actual LED part, the red LED, the green LED, and the blue LED may be disposed adjacent to each other with a certain pattern. In FIG. 3, the first line and the second line of the red LED part will be mainly described. The LED part may include additional red LED lines depending on the resolution, and the green LED part and the blue LED part may be equally applicable.

The display LED module 100*a* includes a plurality of LEDs per line. For example, a plurality of first LEDs 111 and 112 may be disposed in the first and second columns of the first line, and a plurality of second LEDs 113 and 114 may be disposed in the first and second columns of the second line.

A first driver IC 121 may be commonly connected to four LEDs. That is, the first driver IC 121 may be commonly connected to the two first LEDs 111 and 112 arranged in the first and second columns of the first line and two second LEDs 113 and 114 arranged in the first and second columns of the second line. That is, the first driver IC 121 may keep current flowing through the two first LEDs 111 and 112 arranged in the first and second columns of the first line and the two second LEDs 113 and 114 arranged in the first and second columns of the second line.

Similarly, a second driver IC may be commonly connected to two first LEDs arranged in the third and fourth columns of the first line and two second LEDs arranged in the third and fourth columns of the second line. In addition, a third driver IC may be commonly connected to two third LEDs arranged in the first and second columns of the third line and two fourth LEDs arranged in the first and second columns of the fourth line. A fourth driver IC may be commonly connected to two third LEDs arranged in the third and fourth columns of the third line and two fourth LEDs arranged in the third and fourth columns of the fourth line.

Meanwhile, each driver IC may be connected to a cathode of the plurality of LEDs, in which case each driver IC is a data sink driver. According to another exemplary embodiment, each driver IC may be connected to an anode of the plurality of LEDs, in which case the driver IC is a data source driver.

The switch may divide a plurality of LEDs of each line of the LED part, and may be commonly connected to the plurality of divided LEDs. As an exemplary embodiment, the first switch 131 may be commonly connected to a plurality of first LEDs arranged in odd-numbered columns of the first line and the second switch 132 may be commonly connected to a plurality of first LEDs arranged in even-numbered columns of the first line. The third switch 133 may be commonly connected to a plurality of second LEDs arranged in the odd-numbered columns of the second line and the fourth switch 134 may be commonly connected to a plurality of second LEDs arranged in the even-numbered columns of the second line.

Similarly, a fifth switch may be commonly connected to a plurality of third LEDs arranged in the odd-numbered columns of the third line and a sixth switch may be commonly connected to a plurality of third LEDs arranged in the even-numbered columns of the third line. A seventh switch may be commonly connected to a plurality of fourth LEDs arranged in the odd-numbered columns of the fourth line and an eighth switch may be commonly connected to a plurality of fourth LEDs arranged in the even-numbered columns of the fourth line.

An end of each switch may be connected to a power source (exhaustible or non-exhaustible). In an exemplary embodiment, the voltage supplied to the LED part may be 4.2V. A controller may time-divide the LED display module and drive the time-divided LED display module by controlling a plurality of switches in a predetermined pattern using a constant control signal.

Figure 4:
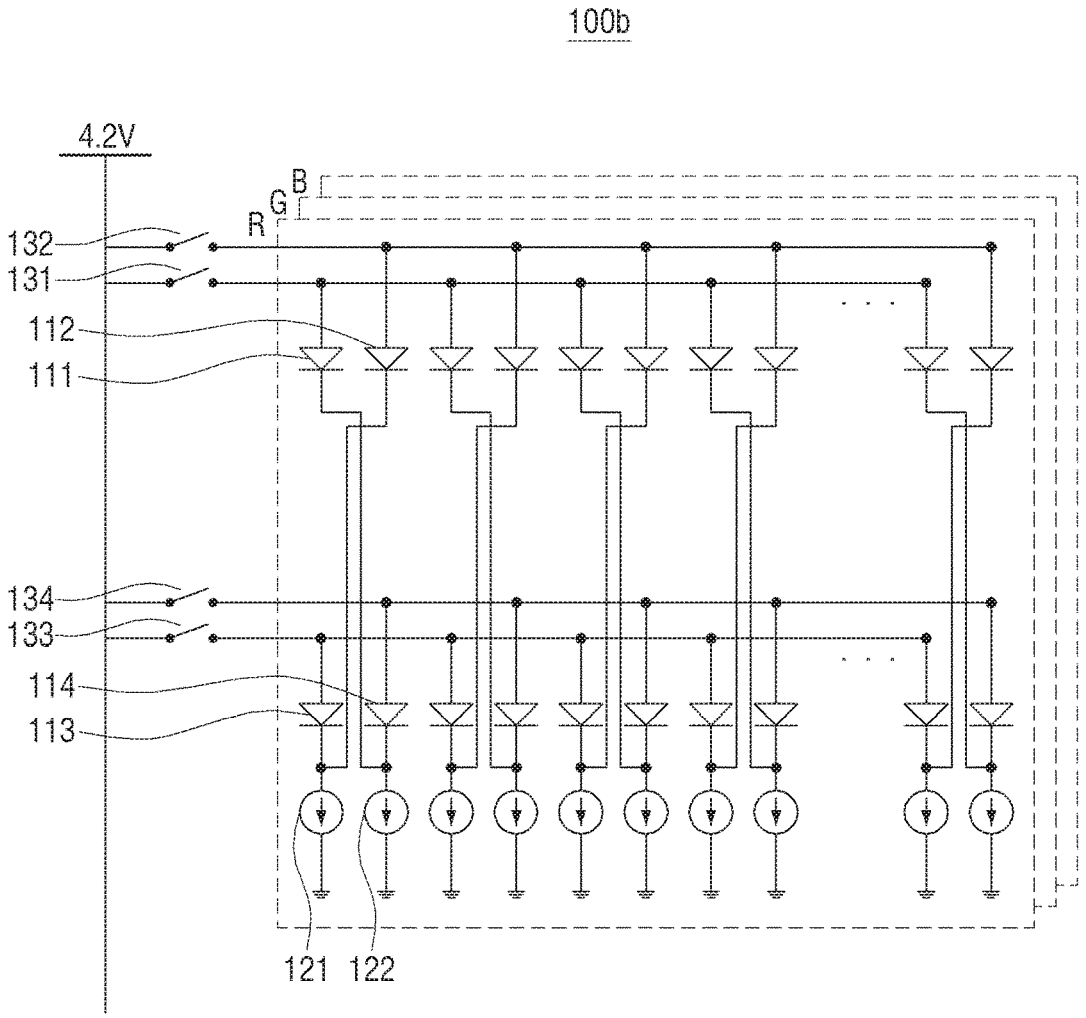
FIG. 4 is a diagram illustrating an LED display module according to a second exemplary embodiment.

FIG. 4 is a diagram illustrating an LED display module 100*b* according to a second exemplary embodiment.

Referring to FIG. 4, the LED display module 100*b* includes LED parts arranged in a line-by-line (e.g., row-by-row) manner, a driver IC, and a switch.

The display LED module 100*b* includes a plurality of LEDs per line. For example, a plurality of first LEDs 111 and 112 may be disposed in the first and second columns of the first line, and a plurality of second LEDs 113 and 114 may be disposed in the first and second columns of the second line.

A first driver IC 121 may be commonly connected to two LEDs. The first driver IC 121 may be commonly connected to the first LED 112 arranged in the second column of the first line and the second LED 113 arranged in the first column of the second line. That is, the first driver IC 121 may be commonly connected to the first LED 112 arranged in the even-numbered columns of the first line and the second LED 113 arranged in the odd-numbered columns of the second line. In addition, a second driver IC 122 may be commonly connected to the first LED 111 arranged in the first column of the first line and the second LED 114 arranged in the second column of the second line. That is, the second driver IC 122 may be commonly connected to the first LED 111 arranged in the odd-numbered columns of the first line and the second LED 114 arranged in the even-numbered columns of the second line. Accordingly, the first driver IC 121 can keep current flowing through the first LED 112 arranged in the second column of the first line and the second LED 113 arranged in the first column of the second line. In addition, the second driver IC 122 may keep current flowing through the first LED 111 arranged in the first column of the first line and the second LED 114 arranged in the second column of the second line.

Similarly, a third driver IC may be commonly connected to a third LED arranged in the second column of the third line and a fourth LED arranged in the first column of the fourth line and a fourth driver IC may be commonly connected to a third LED arranged in the first column of the third line and a fourth LED arranged in the second column of the fourth line.

The switch may divide a plurality of LEDs of each line of the LED part, and may be commonly connected to the plurality of divided LEDs. As an exemplary embodiment, the first switch 131 may be commonly connected to a plurality of first LEDs arranged in odd-numbered columns of the first line and the second switch 132 may be commonly connected to a plurality of first LEDs arranged in even-numbered columns of the first line. A third switch 133 may be commonly connected to a plurality of second LEDs arranged in the odd-numbered columns of the second line and the fourth switch 134 may be commonly connected to a plurality of second LEDs arranged in the even-numbered columns of the second line.

Similarly, a fifth switch may be commonly connected to a plurality of third LEDs arranged in the odd-numbered columns of the third line and a sixth switch may be commonly connected to a plurality of third LEDs arranged in the even-numbered columns of the third line. A seventh switch may be commonly connected to a plurality of fourth LEDs arranged in the odd-numbered columns of the fourth line and an eighth switch may be commonly connected to a plurality of fourth LEDs arranged in the even-numbered columns of the fourth line.

An end of each switch may be connected to a power source. In an exemplary embodiment, the voltage supplied to the LED part may be 4.2V. A controller may time-divide the LED display module and drive the time-divided LED display module by controlling a plurality of switches in a predetermined pattern using a constant control signal.

Figure 5:
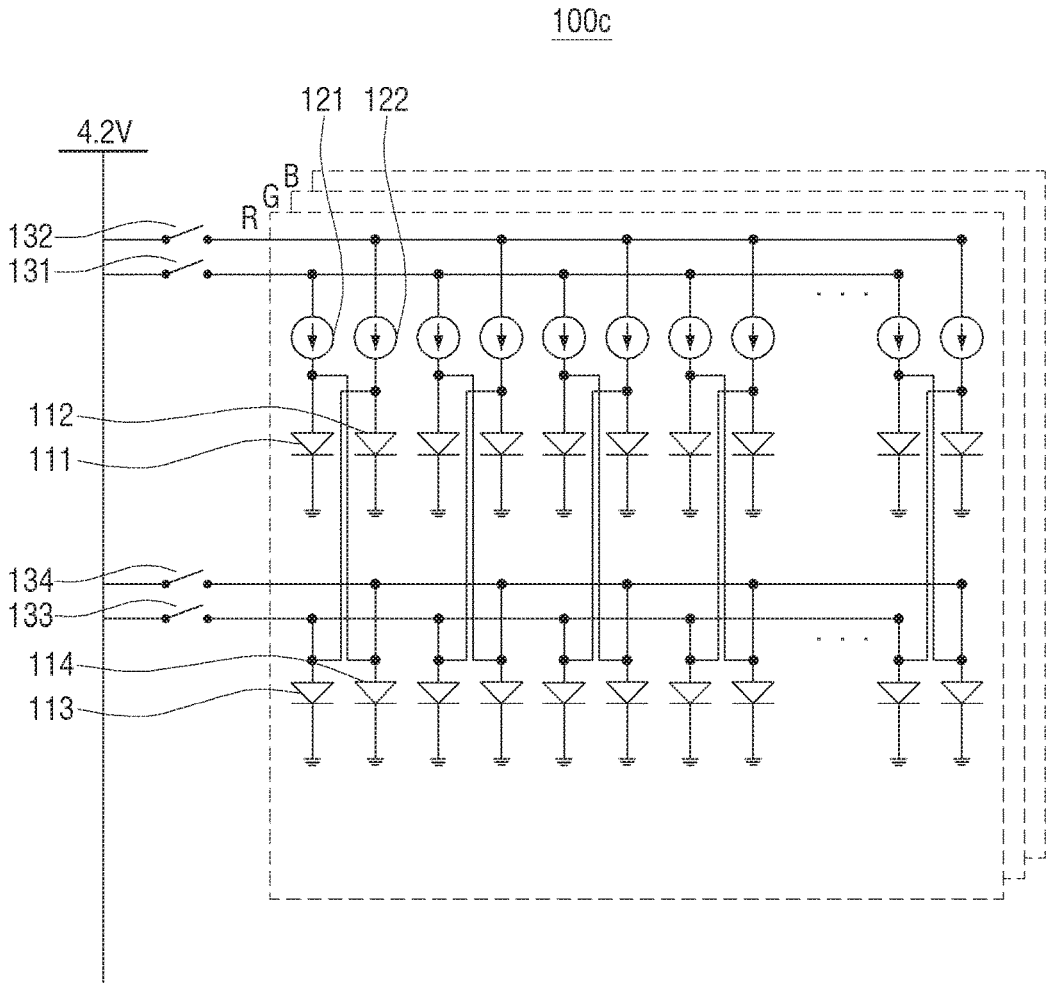
FIG. 5 is a diagram illustrating an LED display module according to a third exemplary embodiment.

FIG. 5 is a diagram illustrating an LED display module 100*c* according to a third exemplary embodiment.

Referring to FIG. 5, the LED display module 100*c* includes LED parts arranged in a line-by-line (e.g., row-by-row) manner, a driver IC, and a switch. The structure of the LED display module 100*c* illustrated in FIG. 5 is similar to that of the LED display module 100*b* described above with reference to FIG. 4.

The driver IC of the LED display module 100*b* illustrated in FIG. 4 is connected to the cathodes of the plurality of LEDs, whereas the driver IC of the LED display module 100*c* illustrated in FIG. 5 is connected to the anodes of the plurality of LEDs.

As described above, when the driver IC is connected to the cathodes of the plurality of LEDs, the driver IC is a data sink driver, and when the driver IC is connected to the anodes of the plurality of LEDs, the driver IC is a data source driver.

The LED display module 100*c* illustrated in FIG. 5 is similar to the LED display module 100*b* described with reference to FIG. 4 except that the driver ICs are located at different positions.

Figure 6:
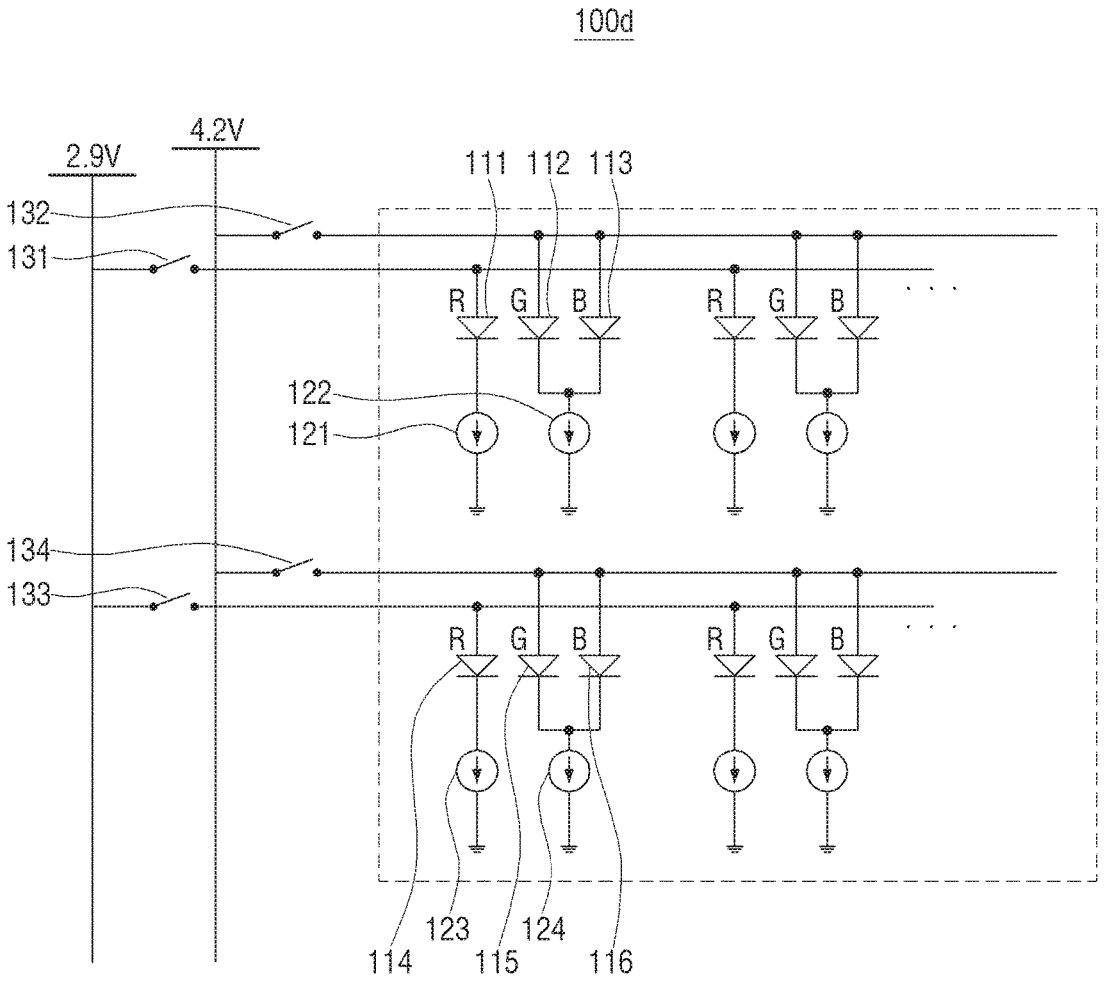
FIG. 6 is a diagram illustrating an LED display module according to a fourth exemplary embodiment.

FIG. 6 is a diagram illustrating an LED display module 100*d* according to a fourth exemplary embodiment.

Referring to FIG. 6, the LED display module 100*d* includes a red LED, a green LED, a blue LED, a driver IC, and a switch arranged by lines. FIG. 6 illustrates an exemplary embodiment in which sub-pixels including a red LED, a green LED and a blue LED are divided and driven.

The display LED module 100*d* includes red LEDs, green LEDs, and blue LEDs line-by-line (e.g., row). Each LED can be connected to a power supply unit via a switch. In an exemplary embodiment, the plurality of red LEDs may be connected to a 2.9V power supply unit, and the plurality of green LEDs and the plurality of blue LEDs may be connected together to a 4.2V power supply unit.

A first driver IC 121 may be connected only to the red LED. That is, the first driver IC 121 may be connected only to the red LED 111 disposed in the first column of the first line. In the present exemplary embodiment, since the red LED is supplied with a different voltage from the green LED or the blue LED, the red LED may be configured as a separate circuit, unlike the other LEDs. A second driver IC 122 may be connected in common to the green LED 112 disposed in the second column of the first line and the blue LED 113 disposed in the third column of the first line. Accordingly, the first driver IC 121 may keep current of the red LED 111 disposed in the first column of the first line constant, and the second driver IC 122 may maintain current of the green LED 112 and the blue LED 113 disposed in the second and third columns of the first line, respectively, constant.

Similarly, a third driver IC 123 is connected only to the red LED 114 disposed in the first column of the second line and a fourth driver IC 124 is commonly connected to the green LED 115 disposed in the second column of the second line and the blue LED 116 disposed in the third column of the second line.

The switch may divide a plurality of LEDs of each line of the LED part, and be commonly connected to the plurality of divided LEDs. In an exemplary embodiment, the first switch 131 may be connected in common to a plurality of red LEDs disposed in the first line. The second switch 132 may be connected in common to a plurality of green LEDs and blue LEDs disposed in the first line. Further, the third switch 133 is commonly connected to a plurality of red LEDs arranged in the second line, and the fourth switch 134 is connected in common to a plurality of green LEDs and blue LEDs arranged in the second line.

A controller may time-divide the LED display module and drive the time-divided LED display module by controlling a plurality of switches in a predetermined pattern using a constant control signal.

Furthermore, each driver IC may be connected to a cathode of the plurality of LEDs, in which case each driver IC is a data sink driver. According to another exemplary embodiment, each driver IC may be connected to an anode of the plurality of LEDs, in which case the driver IC is a data source driver.

Figure 7:
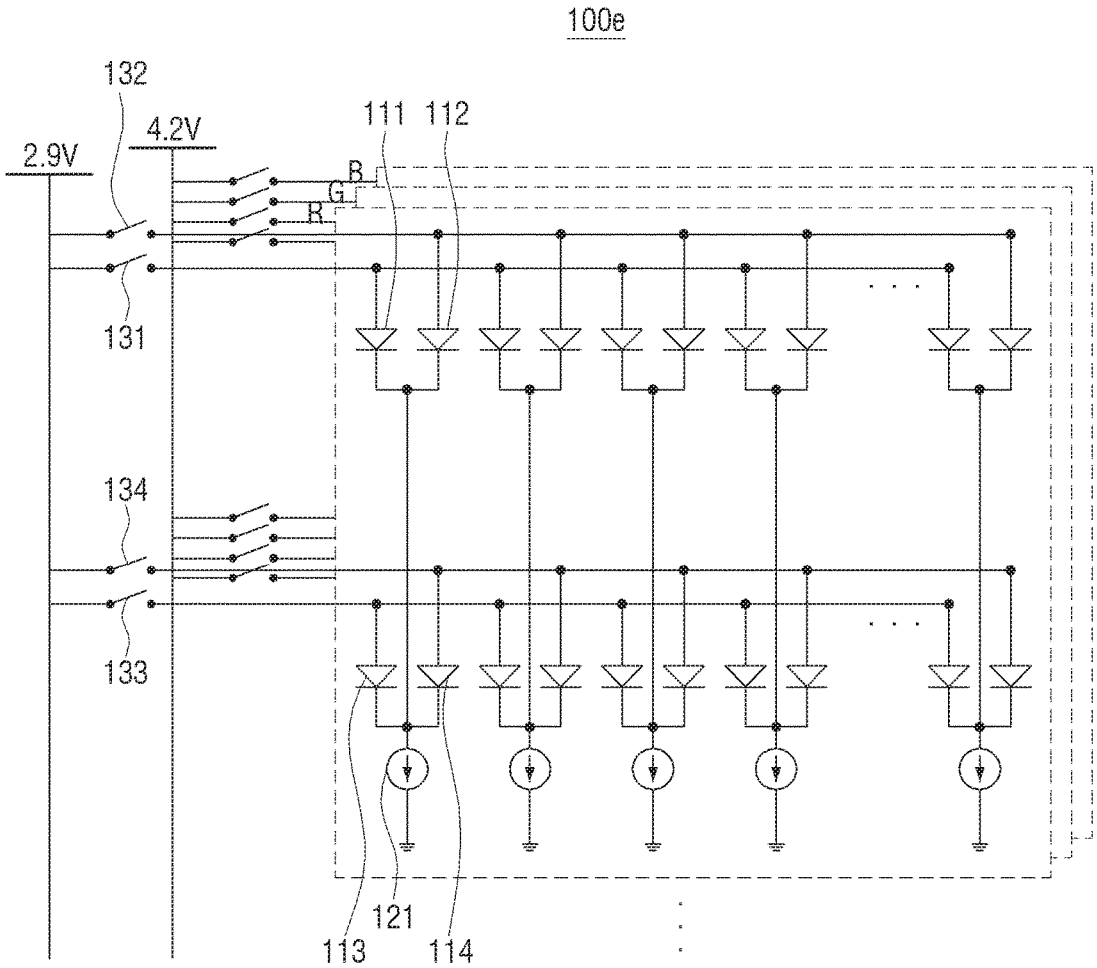
FIG. 7 is a diagram illustrating an LED display module according to a fifth exemplary embodiment.

FIG. 7 is a diagram illustrating an LED display module 100*e* according to a fifth exemplary embodiment.

Referring to FIG. 7, the LED display module 100*e* includes LED parts arranged by line, a driver IC, and a switch.

The display LED module 100*e* includes a plurality of LEDs per line (e.g., row). For example, a plurality of first LEDs 111 and 112 may be disposed in the first and second columns of the first line, and a plurality of second LEDs 113 and 114 may be disposed in the first and second columns of the second line.

A first driver IC 121 may be commonly connected to four LEDs. That is, the first driver IC 121 may be commonly connected to the two first LEDs 111 and 112 arranged in the first and second columns of the first line and the two second LEDs 113 and 114 arranged in the first and second columns of the second line. That is, the first driver IC 121 may keep current flowing through the two first LEDs 111 and 112 arranged in the first and second columns of the first line and the two second LEDs 113 and 114 arranged in the first and second columns of the second line.

Similarly, a second driver IC may be commonly connected to two first LEDs arranged in the third and fourth columns of the first line and two second LEDs arranged in the third and fourth columns of the second line. In addition, a third driver IC may be commonly connected to two third LEDs arranged in the first and second columns of the third line and two fourth LEDs arranged in the first and second columns of the fourth line. A fourth driver IC may be commonly connected to two third LEDs arranged in the third and fourth columns of the third line and two fourth LEDs arranged in the third and fourth columns of the fourth line.

Meanwhile, each driver IC may be connected to a cathode of the plurality of LEDs, in which case each driver IC is a data sink driver. According to another exemplary embodiment, each driver IC may be connected to an anode of the plurality of LEDs, in which case the driver IC is a data source driver.

The switch may divide a plurality of LEDs of each line of the LED part, and may be commonly connected to the plurality of divided LEDs. As an exemplary embodiment, the first switch 131 may be commonly connected to a plurality of first LEDs arranged in odd-numbered columns of the first line and the second switch 132 may be commonly connected to a plurality of first LEDs arranged in even-numbered columns of the first line. The third switch 133 may be commonly connected to a plurality of second LEDs arranged in the odd-numbered columns of the second line and the fourth switch 134 may be commonly connected to a plurality of second LEDs arranged in the even-numbered columns of the second line.

Similarly, a fifth switch may be commonly connected to a plurality of third LEDs arranged in the odd-numbered columns of the third line and a sixth switch may be commonly connected to a plurality of third LEDs arranged in the even-numbered columns of the third line. A seventh switch may be commonly connected to a plurality of fourth LEDs arranged in the odd-numbered columns of the fourth line and an eighth switch may be commonly connected to a plurality of fourth LEDs arranged in the even-numbered columns of the fourth line.

An end of each switch may be connected to a power source. In an exemplary embodiment, the voltage supplied to the red LED part may be 2.9V, and the voltage supplied to the green LED and the blue LED may be 4.2V. A controller may time-divide the LED display module and drive the time-divided LED display module by controlling a plurality of switches in a predetermined pattern using a constant control signal.

Various exemplary embodiments of the configuration of the LED display module have been described so far. A time division driving method according to one or more exemplary embodiments will be described hereinbelow.

Figure 8:
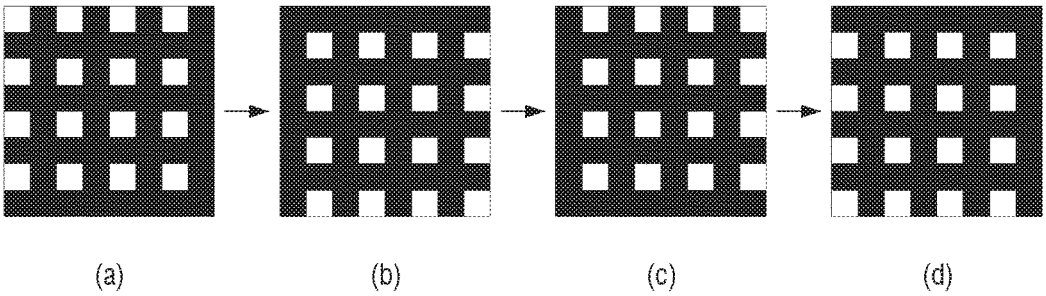
FIG. 8 is a diagram illustrating a time division method of the LED display module according to an exemplary embodiment.

FIG. 8 is a diagram illustrating a time division method of an LED display module according to an exemplary embodiment. Referring to FIG. 8, a process of changing an LED turned on according to time is illustrated. The operation process of the third, fifth, seventh lines and the third and subsequent columns are identical or substantially similar to that of the first and second columns of the first and second lines. Accordingly, the first and second lines of the first and second lines will be described as exemplarily representative. It will be further described in comparison with the LED display module 100*a* of FIG. 3.

In (a) of FIG. 8, the LED of the first column of the first line is turned on. As described above, the LEDs in the odd-numbered columns of the third, fifth, and seventh lines are also turned on. In the first cycle, the first switch 131 of the LED display module 100*a* is turned on. Since the current flows through the first LED 111 in the first column of the first line, the first LED 111 in the first column of the first line is turned on.

In (b) of FIG. 8, the LED of the second column of the second line is turned on. As described above, the LEDs in the even-numbered columns of the fourth, sixth, and eighth lines are also turned on. In the second cycle, the first switch 131 of the LED display module 100*a* is turned off and the fourth switch 134 is turned on. The current flowing in the first LED 111 of the first column of the first line is cut off so that the first LED 111 of the first column of the first line is turned off, and the current flows through the second LED 114 in the second column of the second line so that the second LED 114 in the second column of the second line is turned on.

In (c) of FIG. 8, the LED of the second column of the first line is turned on. As described above, the LEDs in the even-numbered columns of the third, fifth, and seventh lines are also turned on. In the third cycle, the fourth switch 134 of the LED display module 100*a* is turned off and the second switch 132 is turned on. The current flowing in the second LED 111 of the second column of the second line is cut off so that the second LED 111 of the second column of the second line is turned off, and the current flows through the first LED 114 in the second column of the first line so that the first LED 114 in the second column of the first line is turned on.

In (d) of FIG. 8, the LED of the first column of the second line is turned on. As described above, the LEDs in the odd-numbered columns of the fourth, sixth, and eighth lines are also turned on. In the fourth cycle, the second switch 132 of the LED display module 100*a* is turned off and the third switch 133 is turned on. The current flowing in the first LED 112 of the second column of the first line is cut off so that the first LED 112 of the second column of the first line is turned off, and the current flows through the second LED 113 in the first column of the second line so that the second LED 113 in the first column of the second line is turned on. Although the time division method is described based on the LED display module 100*a* illustrated in FIG. 3, it is understood that the LED display modules 100*b*, 100*c*, 100*d*, and 100*e* according to other exemplary embodiments may operate in a similar manner.

In the above-described manner, the LED display module 100*a* may turn on and off the LEDs arranged at the time-divided positions in a predetermined manner. Since the on-off of the LED is repeated at a period that cannot be perceived by a person (for example, 60 Hz), the after-image of the previously turned-on LED allows the user to see the displayed image without feeling flicker. That is, the LED display module may display an image without degrading the image quality.

FIGS. 9A through 9D are diagrams comparing a time division method of an LED display module according to an exemplary embodiment with a related art method.

Figures 9A, 9B, 9C, 9D:
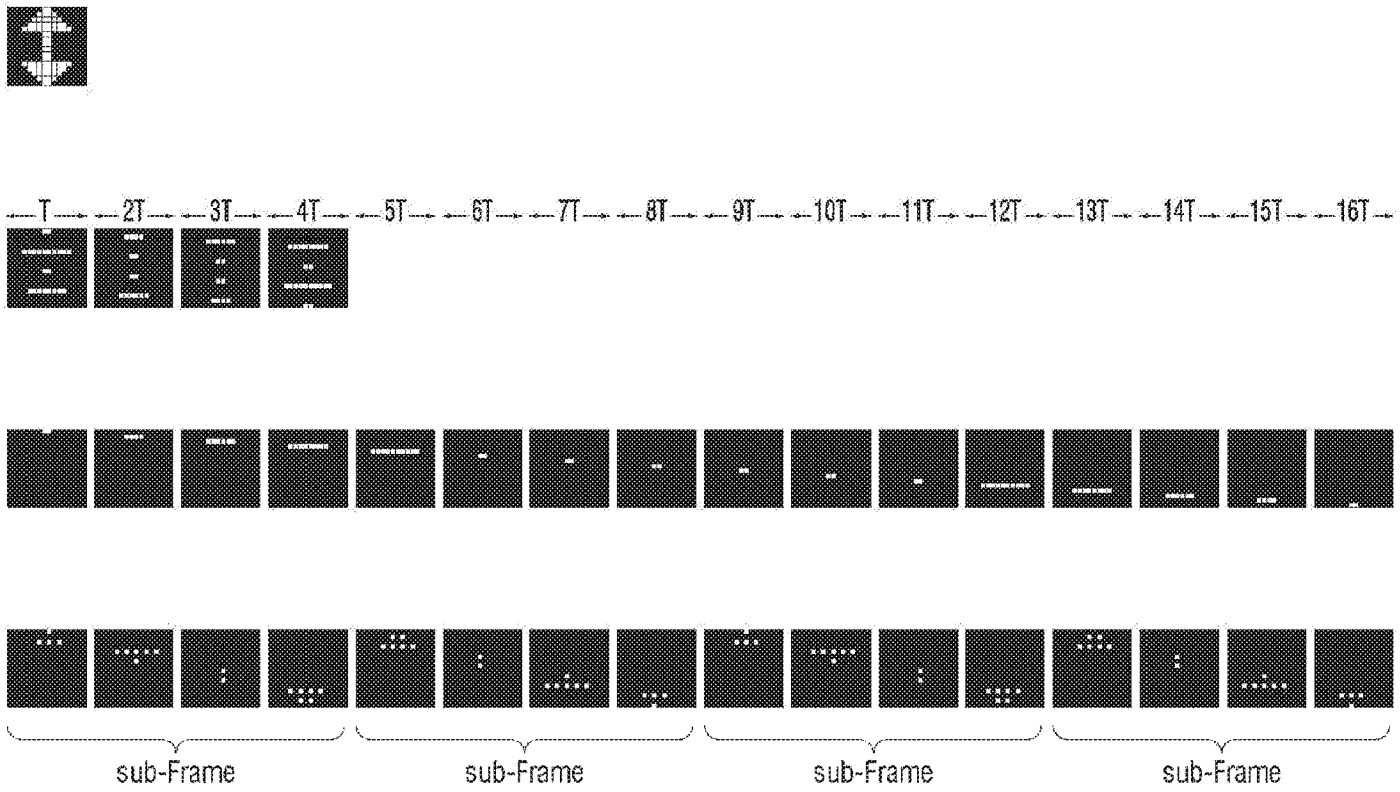
FIGS. 9A through 9D are diagrams comparing a time division method of an LED display module according to an exemplary embodiment with a related art method.

Referring to FIG. 9A, a video image to be displayed is illustrated. Various methods of displaying the video image illustrated in FIG. 9A will be described below.

Referring to FIG. 9B, a related display method will now be described. As described above, in the related art method, each driver IC is connected to each LED (i.e., on a one-to-one basis), and a switch is connected line-by-line. When the size of the display module is 16 lines (e.g., rows), the display module may display video or image data by a driving method that divides the module into four areas. That is, the display module is divided such that the first to fourth lines are referred to as a first area, the fifth to eighth lines are referred to as a second area, the ninth to 12th lines are referred to as a third area, and the 13th to 16th lines are referred to as a fourth area.

The switches of the first, fifth, ninth, and 13th lines of each area of the display module in the first period are turned on so that all LEDs of the first, fifth, ninth, and 13th lines are turned on. All the LEDs of the second, sixth, 10th, and 14th lines may be turned on in the second cycle. All the LEDs in the third, seventh, 11th, and 15th lines may be turned on in the third cycle. In the fourth cycle, all the LEDs of the fourth, eighth, 12th, and 16th lines may be turned on. For example, if one period is about 4.17 ms, the time taken until the fourth period is about 16.7 ms. When the fourth cycle is completed, the video image of FIG. 9A may be displayed once as a whole. Thus, the display module of FIG. 9A operates at about 60 Hz. When operated at 60 Hz, the LED display module does not generate flicker. However, as described above, since a number of driver ICs is equal to the number of LEDs, a related art display module is disadvantageous in terms of volume, yield, and cost.

A display module in which a plurality of LEDs are commonly connected to one driver IC will now be described. FIG. 9C illustrates an operation process of a display module in which a plurality of LEDs are commonly connected to one driver IC.

Since the display module of FIG. 9C includes one driver IC connected to a plurality of LEDs and the switches are commonly connected to all the LEDs of each line, the LEDs may be controlled line-by-line. That is, when the size of the display module is 16 lines, if the LEDs arranged in one line are turned on every cycle, sixteen cycles are required to display the entire image. As described above, when one cycle is about 4.17 ms, the time taken until the 16th cycle is about 66.7 ms. Thus, the display module of FIG. 9C operates at about 15 Hz. When the display module operates at 15 Hz, the user may feel the flicker. In the case of the display module of FIG. 9C, since the display module is to operate four times faster in order to operate at 60 Hz, a large load is required.

Referring to FIG. 9D, a method of operating the display module according to an exemplary embodiment is illustrated. In the same manner as in FIG. 9C, a plurality of LEDs may be connected to one driver IC of the display module, and a switch may be connected to each of the odd columns and a separate switch may be connected to each of the even columns. As described above, the LED display module according to an exemplary embodiment may perform LED control according to lines (e.g., rows) and columns. Accordingly, in the LED display module according to an exemplary embodiment, the odd-numbered columns of the first line and the odd-numbered columns of the third line are turned on at the same time, the odd-numbered columns of the first line and the odd-numbered columns of the third line are simultaneously turned off, and the odd-numbered columns of the fifth line and the odd-numbered columns of the seventh line may be simultaneously turned on. In addition, the odd-numbered column of the ninth line and the odd-numbered column of the 11th line are simultaneously turned on while the odd-numbered column of the 5th line and the odd-numbered column of the 7th line are simultaneously turned off. Thereafter, the odd-numbered column in the ninth line and the odd-numbered column in the 11th line may be simultaneously turned off, while the odd-numbered column in the 13th line and the odd-numbered column in the 15th line are simultaneously turned on. After the odd-numbered LEDs are turned on once, the even-numbered LEDs may be turned on in the same manner as the odd-numbered LEDs.

Even though the operation method of FIG. 9D does not display the entirety of the video image during each of the four periods, the entire video image is overlapped with the entire area of the video image and displayed. Accordingly, in view of the after-image effect, the operation method of FIG. 9D has the same effect as displaying the entire video image in each of the four periods. When one period is about 4.17 ms, the time taken until the fourth period is about 16.7 ms. Therefore, since the display module of FIG. 9D operates at about 60 Hz, it is possible to display an image without deterioration of the screen including flicker and the like.

Figure 10:
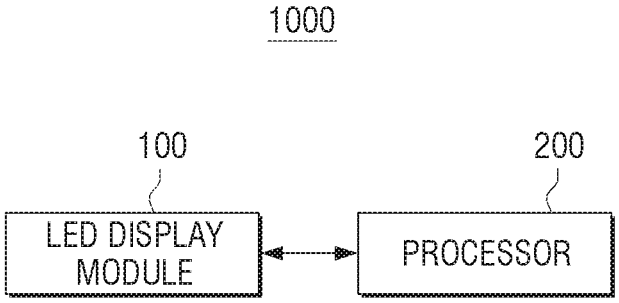
FIG. 10 is a block diagram of a display apparatus according to an exemplary embodiment.

FIG. 10 is a block diagram of a display apparatus 1000 according to an exemplary embodiment.

Referring to FIG. 10, a display apparatus 1000 includes an LED display module 100 and a processor 200.

The LED display module 100 includes an LED part including a first line (e.g., row) in which a plurality of first LEDs are arranged and a second line in which a plurality of second LEDs are arranged, a first driver IC commonly connected to at least one of the plurality of first LEDs and at least one of the plurality of second LEDs and a second driver IC commonly connected to another at least one of the plurality of first LEDs and another at least one of the plurality of second LEDs, first and second switches respectively connected to the plurality of first LEDs and the plurality of second LEDs disposed in the odd-numbered columns of the first and second lines and third and fourth switches respectively connected to a plurality of first LEDs and a plurality of second LEDs disposed in the even-numbered columns of the first and second lines, and a controller configured to control the first to fourth switches to be sequentially turned on.

In addition, the LED part may further include a third line in which a plurality of third LEDs are arranged and a fourth line in which a plurality of fourth LEDs are arranged, and may further include a third driver IC commonly connected to at least one of the plurality of third LEDs and at least one of the plurality of fourth LEDs and a fourth driver IC commonly connected to another at least one of the plurality of third LEDs and another at least one of the plurality of fourth LEDs, and fifth and sixth switches respectively connected to the plurality of third LEDs and the plurality of fourth LEDs disposed in the odd-numbered columns of the third and fourth lines and seventh and eighth switches respectively connected to a plurality of third LEDs and a plurality of fourth LEDs disposed in the even-numbered columns of the third and fourth lines.

The processor 200 may control the controller to switch the switch according to a certain (e.g., predetermined) method. In other words, the processor 200 may sequentially turn on the first, second, third, and fourth switches, and may control the fifth, sixth, seventh, and eighth switches to be turned on simultaneously with the first, second, third, and fourth switches, respectively. Since specific exemplary embodiments have been described above, redundant descriptions thereof are omitted herein.

The control method of the LED display module according to the above-described various exemplary embodiments may be implemented by a program and provided to an LED display module or an LED display apparatus. As an example, a non-transitory computer readable medium may be provided in which a program executable to perform each step of the control method is stored.

The non-transitory computer readable medium may refer to a medium that stores data and is readable by an apparatus or a processor. In detail, the above-described various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like, and may be provided. Additionally, at least one hardware processor may be provided in the above-described apparatuses and devices to execute the aforementioned program.

The foregoing exemplary embodiments and advantages are merely exemplary and are not to be construed as limiting the present inventive concept. The present teaching can be readily applied to other types of apparatuses. Also, the description of exemplary embodiments is intended to be illustrative, and not to limit the scope of the claims, and many alternatives, modifications, and variations will be apparent to those skilled in the art.

What is claimed is:

1. A light emitting diode (LED) display module, comprising:

an LED part comprising a plurality of first LEDs in a first row and a plurality of second LEDs in a second row;

a first driver integrated circuit (IC) commonly connected to at least one of the plurality of first LEDs and at least one of the plurality of second LEDs, and a second driver IC commonly connected to another at least one of the plurality of first LEDs and another at least one of the plurality of second LEDs;

a first switch connected to a plurality of the first LEDs disposed in odd-numbered columns of the first row, a second switch connected to a plurality of the second LEDs disposed in odd-numbered columns of the second row, a third switch connected to a plurality of the first LEDs disposed in even-numbered columns of the first row, and a fourth switch connected to a plurality of the second LEDs disposed in even-numbered columns of the second row; and a controller configured to control the first to fourth switches to be sequentially turned on, wherein the first switch is not connected to the plurality of the first LEDs disposed in the even-numbered columns of the first row, wherein the second switch is not connected to the plurality of the second LEDs disposed in the even-numbered columns of the second row, wherein the third switch is not connected to the plurality of the first LEDs disposed in the odd-numbered columns of the first row, and wherein the fourth switch is not connected to the plurality of the second LEDs disposed in the odd-numbered columns of the second row.

2. The LED display module as claimed in claim 1, wherein the LED part further comprises:

a plurality of third LEDs in a third row, and a plurality of fourth LEDs in a fourth row;

a third driver IC commonly connected to at least one of the plurality of third LEDs and at least one of the plurality of fourth LEDs, and a fourth driver IC commonly connected to another at least one of the plurality of third LEDs and another at least one of the plurality of fourth LEDs; and a fifth switch connected to a plurality of the third LEDs disposed in odd-numbered columns of the third row, a sixth switch connected to a plurality of the fourth LEDs disposed in odd-numbered columns of the fourth row, a seventh switch connected to a plurality of the third LEDs disposed in even-numbered columns of the third row, and an eighth switch connected to a plurality of the fourth LEDs disposed in even-numbered columns of the fourth row, and wherein the controller is configured to control the first, second, third, and fourth switches to be sequentially turned on, and to control the fifth, sixth, seventh, and eighth switches to be turned on simultaneously with the first, second, third, and fourth switches, respectively.

3. The LED display module as claimed in claim 1, wherein:

the first driver IC is commonly connected to two first LEDs disposed in first and second columns of the first row and two second LEDs disposed on the first and second columns of the second row; and the second driver IC is commonly connected to two first LEDs disposed in third and fourth columns of the first row and two second LEDs disposed in the third and fourth columns of the second row.

4. The LED display module as claimed in claim 1, wherein the controller is configured to, in response to a specific switch being turned on, selectively disable a driver IC controlling a current of an LED connected to the specific switch based on an image to be displayed in the LED part.

5. The LED display module as claimed in claim 1, wherein the LED part further comprises:

a plurality of third LEDs and a plurality of fourth LEDs;

a third driver IC commonly connected to at least one of the plurality of third LEDs and at least one of the plurality of fourth LEDs, and a fourth driver IC commonly connected to another at least one of the plurality of third LEDs and another at least one of the plurality of fourth LEDs; and a fifth switch connected to a first plurality of the third LEDs, a sixth switch connected to a first plurality of the fourth LEDs, a seventh switch connected to a second plurality of the third LEDs, and an eighth switch connected to a second plurality of the fourth LEDs, and wherein the controller is configured to control the first, second, third, and fourth switches to be sequentially turned on, and to control the fifth, sixth, seventh, and eighth switches to be turned on simultaneously with the first, second, third, and fourth switches, respectively.

6. A display apparatus, comprising:

an LED display module; and a processor configured to control driving of the LED display module, wherein the LED display module comprises:

an LED part comprising a plurality of first LEDs in a first row and a plurality of second LEDs in a second row;

a first driver IC commonly connected to at least one of the plurality of first LEDs and at least one of the plurality of second LEDs, and a second driver IC commonly connected to another at least one of the plurality of first LEDs and another at least one of the plurality of second LEDs;

a first switch connected to a plurality of the first LEDs disposed in odd-numbered columns of the first row, a second switch connected to a plurality of the second LEDs disposed in odd-numbered columns of the second row, a third switch connected to a plurality of the first LEDs disposed in even-numbered columns of the first row, and a fourth switch connected to a plurality of the second LEDs disposed in even-numbered columns of the second row; and a controller configured to control the first to fourth switches to be sequentially turned on, and wherein the processor is configured to control the controller, wherein the first switch is not connected to the plurality of the first LEDs disposed in the even-numbered columns of the first row, wherein the second switch is not connected to the plurality of the second LEDs disposed in the even-numbered columns of the second row, wherein the third switch is not connected to the plurality of the first LEDs disposed in the odd-numbered columns of the first row, and wherein the fourth switch is not connected to the plurality of the second LEDs disposed in the odd-numbered columns of the second row.

7. The apparatus as claimed in claim 6, wherein the LED part further comprises:

a plurality of third LEDs in a third row, and a plurality of fourth LEDs in a fourth row;

a third driver IC commonly connected to at least one of the plurality of third LEDs and at least one of the plurality of fourth LEDs, and a fourth driver IC commonly connected to another at least one of the plurality of third LEDs and another at least one of the plurality of fourth LEDs; and a fifth switch connected to a plurality of the third LEDs disposed in odd-numbered columns of the third row, a sixth switch connected to a plurality of the fourth LEDs disposed in odd-numbered columns of the fourth row, a seventh switch connected to a plurality of third LEDs disposed in even-numbered columns of the third row, and an eighth switch connected to a plurality of fourth LEDs disposed in even-numbered columns of the fourth row, and wherein the controller is configured to control the first, second, third, and fourth switches to be sequentially turned on, and to control the fifth, sixth, seventh, and eighth switches to be turned on simultaneously with the first, second, third, and fourth switches, respectively.

8. The apparatus as claimed in claim 6, wherein:

the first driver IC is commonly connected to two first LEDs disposed in first and second columns of the first row and two second LEDs disposed in the first and second columns of the second row; and the second driver IC is commonly connected to two first LEDs disposed in third and fourth columns of the first row and two second LEDs disposed in the third and fourth columns of the second row.

9. The apparatus as claimed in claim 6, wherein the processor is configured to, in response to a specific switch being turned on, control the controller to selectively disable a driver IC controlling a current of an LED connected to the specific switch based on an image to be displayed in the LED part.

* * * * *